US005440465A

United States Patent [19]

Hasness

[11] Patent Number: 5,440,465

[45] Date of Patent: Aug. 8, 1995

[54] COMBINATION FLASHLIGHT HOLSTER-LIGHTWAND DEVICE

[75] Inventor: Richard S. Hasness, Langhorne, Pa.

[73] Assignee: Walterscott International Corp., Bensalem, Pa.

[21] Appl. No.: 195,476

[22] Filed: Feb. 14, 1994

[51] Int. Cl.[6] ..... F21L 7/00

[52] U.S. Cl. ..... 362/191; 362/103; 362/208; 362/396; 362/398

[58] Field of Search ..... 362/190, 191, 186, 208, 362/351, 355, 359, 396, 398, 103, 108; 220/2.1 R; 206/573

[56] References Cited

U.S. PATENT DOCUMENTS

| | | | |
|---|---|---|---|
| 2,486,998 | 11/1949 | Szeklinski | 340/321 |
| 3,418,651 | 12/1968 | Jacobson | 340/321 |
| 3,737,649 | 6/1973 | Nelson et al. | 362/202 |
| 3,970,228 | 7/1976 | Keller | 224/5 H |
| 4,020,985 | 5/1977 | Halterman | 224/5 R |
| 4,214,688 | 7/1980 | Griffin, Jr. | 224/197 |
| 4,462,064 | 7/1984 | Schweitzer | 362/105 |
| 4,508,249 | 4/1985 | Kotchy | 224/219 |
| 4,631,644 | 12/1986 | Dannhauer | 362/105 |
| 4,697,228 | 9/1987 | Mui et al. | 362/352 |
| 4,740,874 | 4/1988 | Wylie et al. | 362/190 X |
| 5,045,979 | 9/1991 | Stevens | 362/108 |
| 5,056,696 | 10/1991 | Lahr | 224/148 |
| 5,181,774 | 1/1993 | Lane | 362/191 X |

*Primary Examiner*—Stephen F. Husar
*Attorney, Agent, or Firm*—Hoffman, Wasson & Gitler

[57] ABSTRACT

The subject invention combines the function of a flashlight holster with the function of a light wand. The combined functions are provided by a shaped, translucent receptacle, into which the flashlight is protectively inserted and carried. Part of the holster-wand may incorporate an attachment for facilitating removable securement of the holster-wand combination to the carrier's person. The holster-wand combination may incorporate a flexibly attached cap which acts as a flashlight lens protector and/or as a color coded signalling device. The combination may advantageously include an internal bottom spring, which allows the accommodation of various length flashlights. The combination is attachable to the user's person via a clip, such as a belt-clip, or it may be attached to a stationary object. In an alternate embodiment, the invention is fastened to the clip via a permanent magnet assembly.

45 Claims, 13 Drawing Sheets

COMBINATION FLASHLIGHT HOLSTER-LIGHTWAND DEVICE

BACKGROUND OF THE INVENTION

1. Field of the Invention

The present invention relates to illuminated safety devices, particularly hand-held presence or position indicators, manually-operated traffic control devices, and the like.

2. Description of the Prior Art

Providing a means of effectively directing vehicular traffic has been a problem for modern living. Devices have long been available that are commonly referred to as light or traffic wands. These are usually specific-purpose, dedicated units that contain their own self-powered light source, or are separate devices that attach to a flashlight, such that the flashlight serves as the light source. Except for the "rear end storage" of a "Collapsible Light Wand", described in U.S. Pat. No. 4,697,228, the prior art light/traffic wands are devices having a single function, and both before and after use of that specific function, the device must be retrievably stored someplace, for later re-use. This, in many instances, turns out to be quite a nuisance, since these items can so easily become lost or misplaced.

U.S. Pat. No. 3,970,228 discloses a flashlight holder including a ring. The internal diameter of the ring is greater than the diameter of the body of the flashlight, but less than the diameter of the flashlight's head. The flashlight is carried by the holder from the belt of the user. The ring holds the flashlight by interfering with the head thereof.

U.S. Pat. No. 3,737,649 discloses a combination baton-flashlight incorporating a support ring which is made of a malleable material. The ring serves to suspend the baton-flashlight from the belt of the wearer via a holding strap in conjunction with a holding ring. The ring holds the baton-flashlight from the underside of the support ring.

U.S. Pat. No. 4,214,688 discloses a tool holder assembly, such as a flashlight holder, including a base member, a tool clip member, a spring and a fastener. The fastener attaches to the base member. The base member serves as a mounting clip to removably mount the tool holder either on the flashlight user or on an object that can support both the tool holder and a flashlight.

U.S. Pat. No. 4,020,985 discloses an equipment holder, including a strap portion, an outer ring and an inner ring. The strap portion comprises a loop, which is positioned over the user's belt.

U.S. Pat. No. 5,056,696 discloses a beverage container holder, which may be worn on the belt of the user. The holder comprises a single piece body, having a lower container support and an upper container retainer.

SUMMARY OF THE INVENTION

The subject invention alleviates the aforementioned negative aspects of existing devices of this type and further provides numerous additional advantages.

Therefore, it is an object of the invention to combine the heretofore separate functions of a flashlight holster and a light wand into a combinational device that can be produced with a reduced number of parts, in a shorter period of time and at a beneficially lower cost.

It is a further object of the invention to eliminate the previously required necessity of having to consider just what storage facilities to utilize for the light wand, while simultaneously providing the oft-times difficult to obtain immediate access to and implementation of the light wand function.

It is another object of the invention to reduce the combinational bulk and weight as compared to any previously disclosed device, thereby totally unencumbering the basic flashlight and allowing it to be more easily carried, handled and manipulated.

Other advantages of this invention will be apparent from those skilled in the art from the following detailed description taken in conjunction with the drawings and the appended claims.

DETAILED DESCRIPTION OF THE PREFERRED EMBODIMENT

The subject invention 12, hereinafter also referred to in the alternative as a holster-wand, is lightweight, easy to use and manufacture, and economical.

Figure 1:
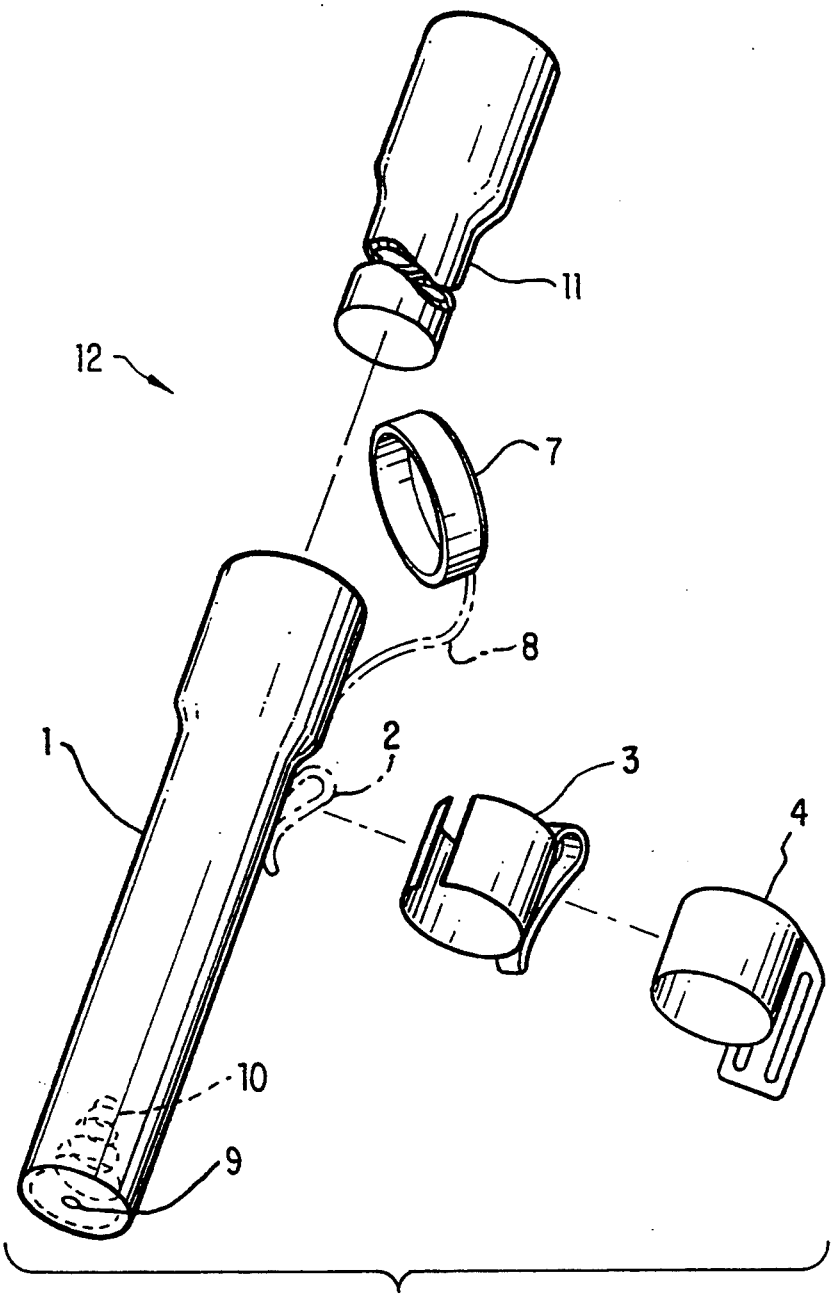
FIG. 1 shows an overall view of the subject invention, and its associated parts.

As can plainly be seen in FIG. 1, the holster-wand 12 has several main components. The light-wand component is designated as 1. It is essentially a shaped receptacle, made of a light diffusing material such as a molded transparent or semi-transparent plastic, having optimal optical and light diffusing properties. The color of the light-wand 1 may be chosen from the field of well-known safety colors, such as blaze orange, green or yellow. In fact, the color chosen may be selected so as to identify the user or an organization to which he or she belongs. For instance, the ground crew workers of a particular airline may choose a light-wand 1 color such as green, while the ground crew workers of a competing airline may choose yellow as their light-wand color.

The light-wand function is provided by the light-wand 1 by constructing it from a light-transmitting, translucent material of appropriate color and optical character, with a necked down region near its top end, inclined to provide a wedging or physical fit function to facilitate removable securement of the head of a flashlight 11 to the near top side end of the light-wand 1, as illustrated in FIG. 1. The far end or tip of the light-wand 1 may be either open or closed. If the far end is closed, a drip or pressure release hole 9 is provided to allow for the release of accumulated moisture or air pressure. A protective cap 7 is also provided, which may be beneficially translucent or transparent, to permit the flashlight 11 to be operated, with either diffused or undiminished optical characteristics, while the flashlight 11 is totally within the environment of the light-wand 1.

The protective cap 7 is reliably secured to the body of the holster-wand 1 to prevent the cap 7 from being lost. A suitable means of securing the cap 7 is an integrally molded tether or strap 8, as shown in FIG. 1.

An integral belt clip, or referred to in the alternative as a spring clip, 2 is provided at a convenient location on the exterior of the holster-wand, so that the user can readily attach the device to his or her belt. As an alternative to the belt clip 2, depending upon the specific usage intended, a sleeve-clip 3 may be used. The longitudinal body portion of the wand 1, would in one embodiment simply slip into the annular opening of the sleeve-clip 3. In a second embodiment, the body portion of wand 1 would be removably insertable from the sleeve-clip 3 by a side ways forcing action that would momentarily open axially split spring-like jaws which are integrally formed in the sleeve clip 3. As can be readily appreciated, the spring clip 2 can be clipped onto a convenient securement location by the user, such as, but not limited to, a belt, trouser waistband, etc.

Figure 12:
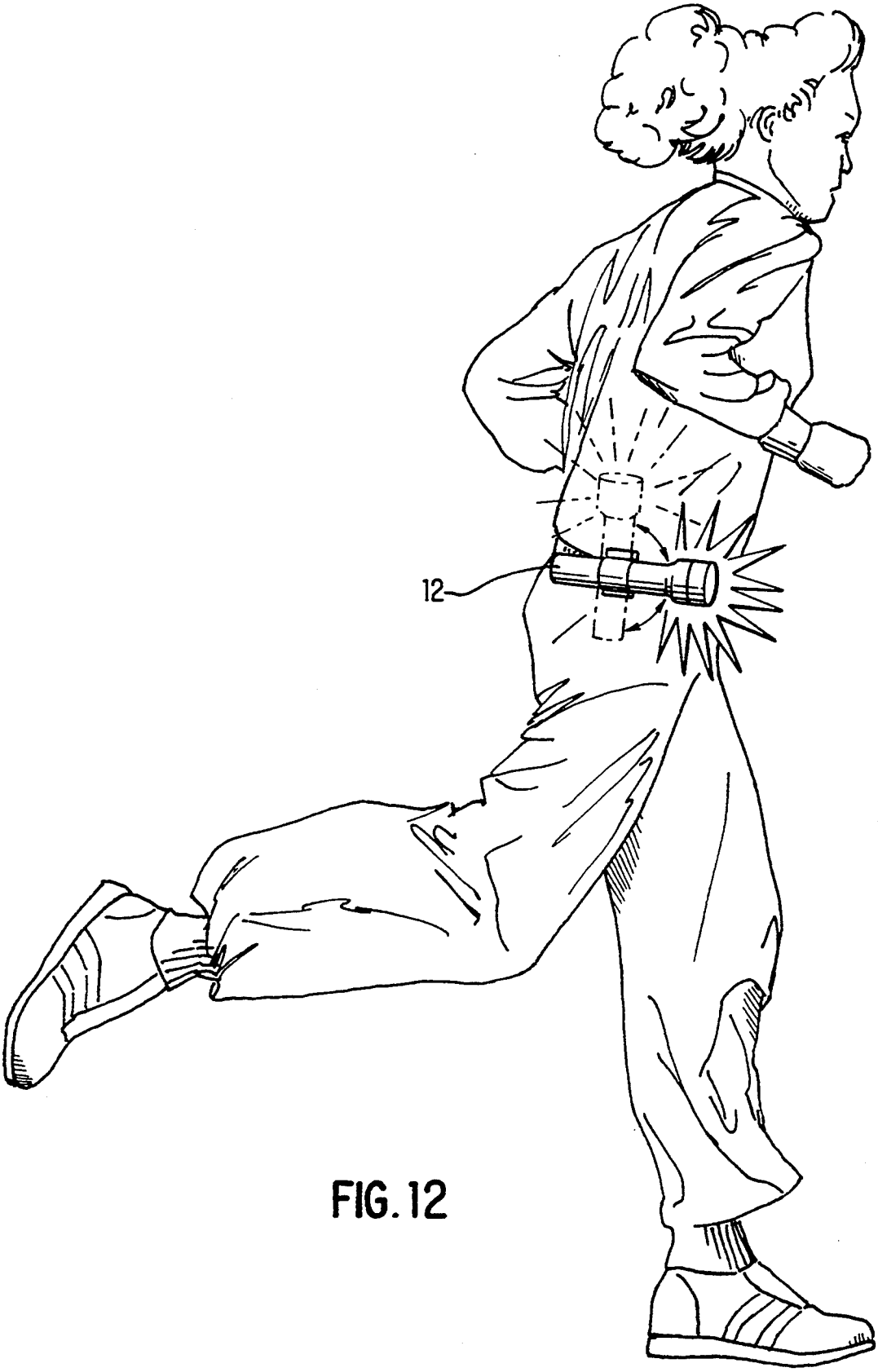
FIGS. 12–15 show examples of users of the subject invention.

For the spring clip 2, and also for the sleeve-clip 3, Applicant intended for the clip 2, 3, to be attached to the user's garment at a convenient location, which would serve the greatest purpose for the user. Now, by garment, Applicant means a belt, belt loop, waist band, a pocket edge, or the like. Although it can readily be envisioned that the spring clip 2 or sleeve clip 3 attaches to the belt of the user. Applicant also envisions that, in the event that the user is wearing shorts or perhaps a jogging suit such as shown in FIG. 12, he or she would probably not be wearing a belt. Thus, the inventive holster wand 12 could readily be attached to the waist band of the user's pants or shorts.

Figure 16:
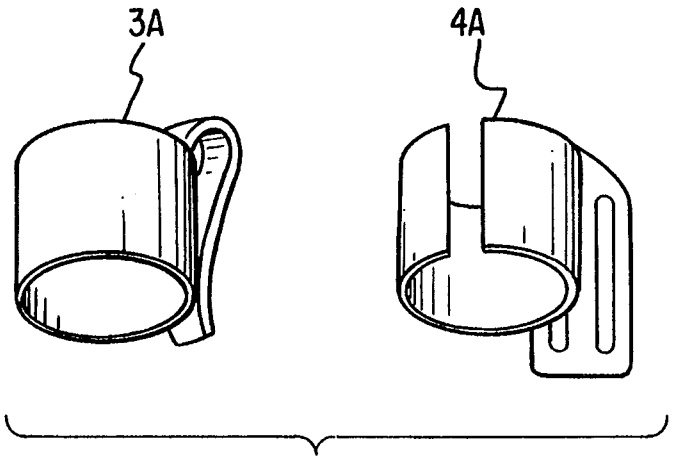
FIG. 16 shows alternate clips.
Figure 3:
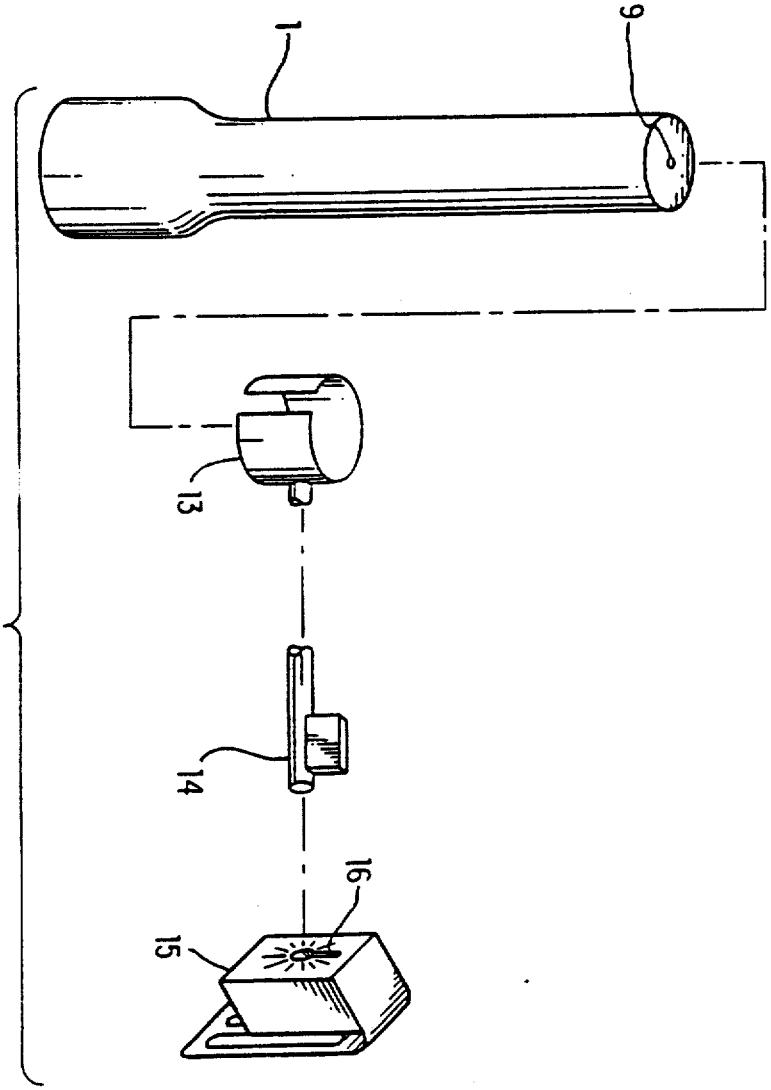
Figure 12:
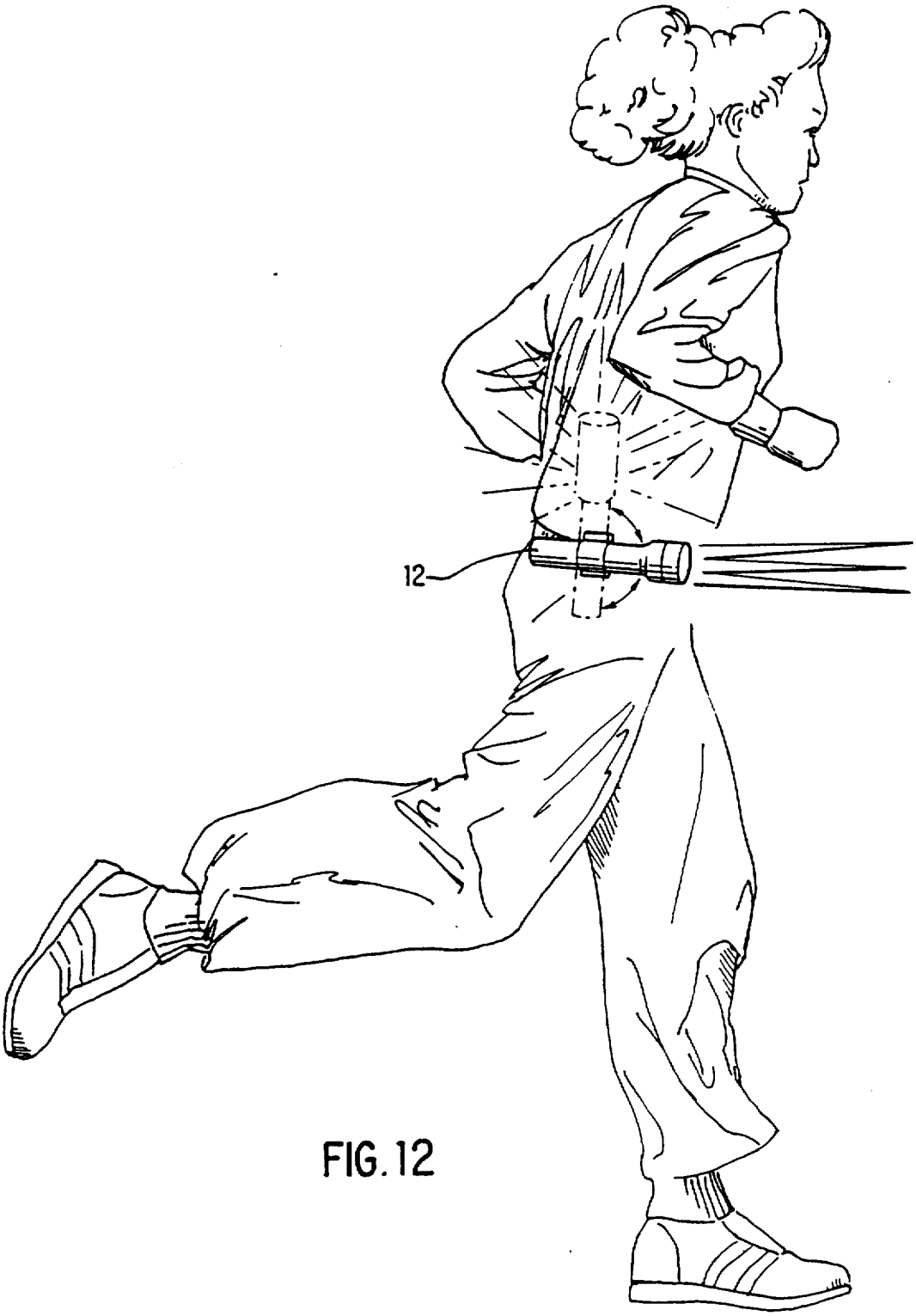
Figure 14:
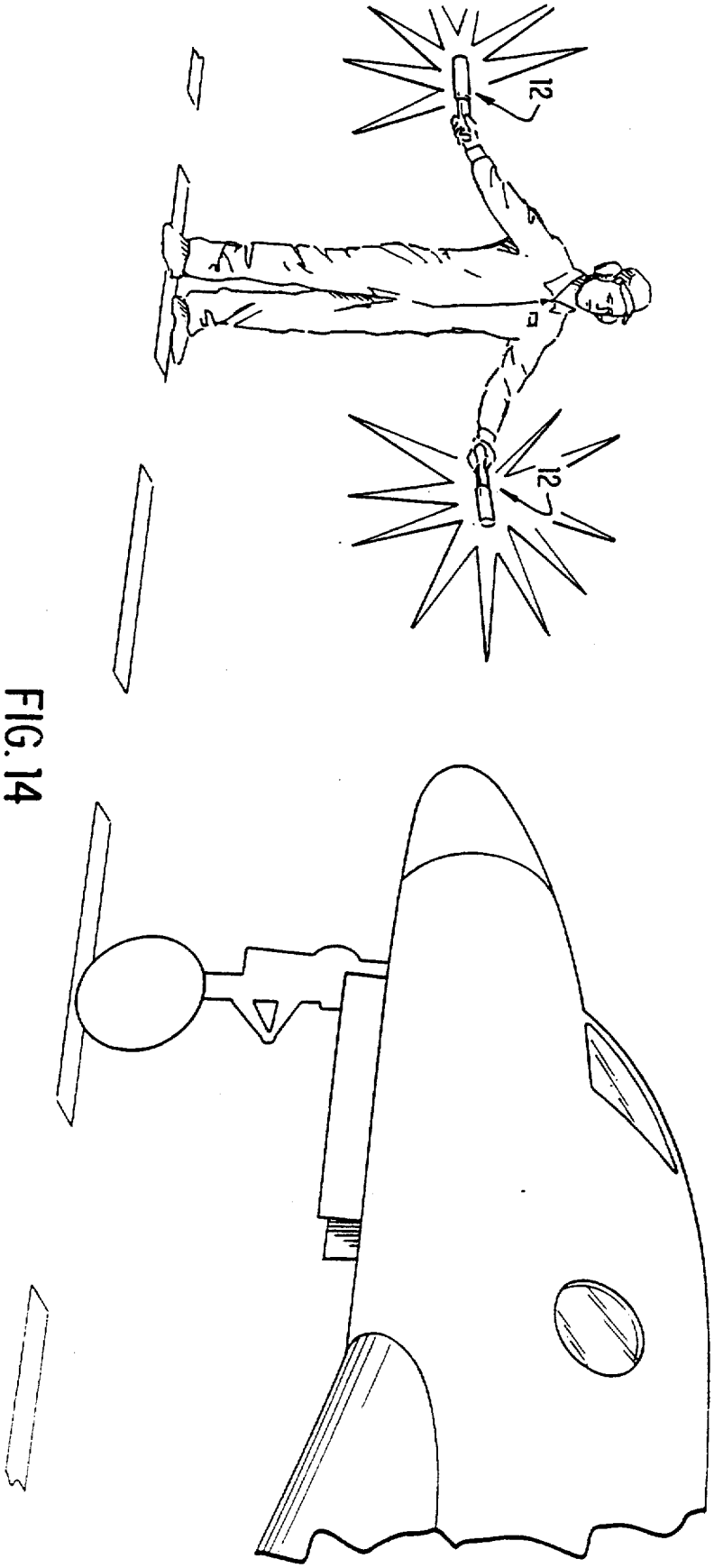
Figure 15:
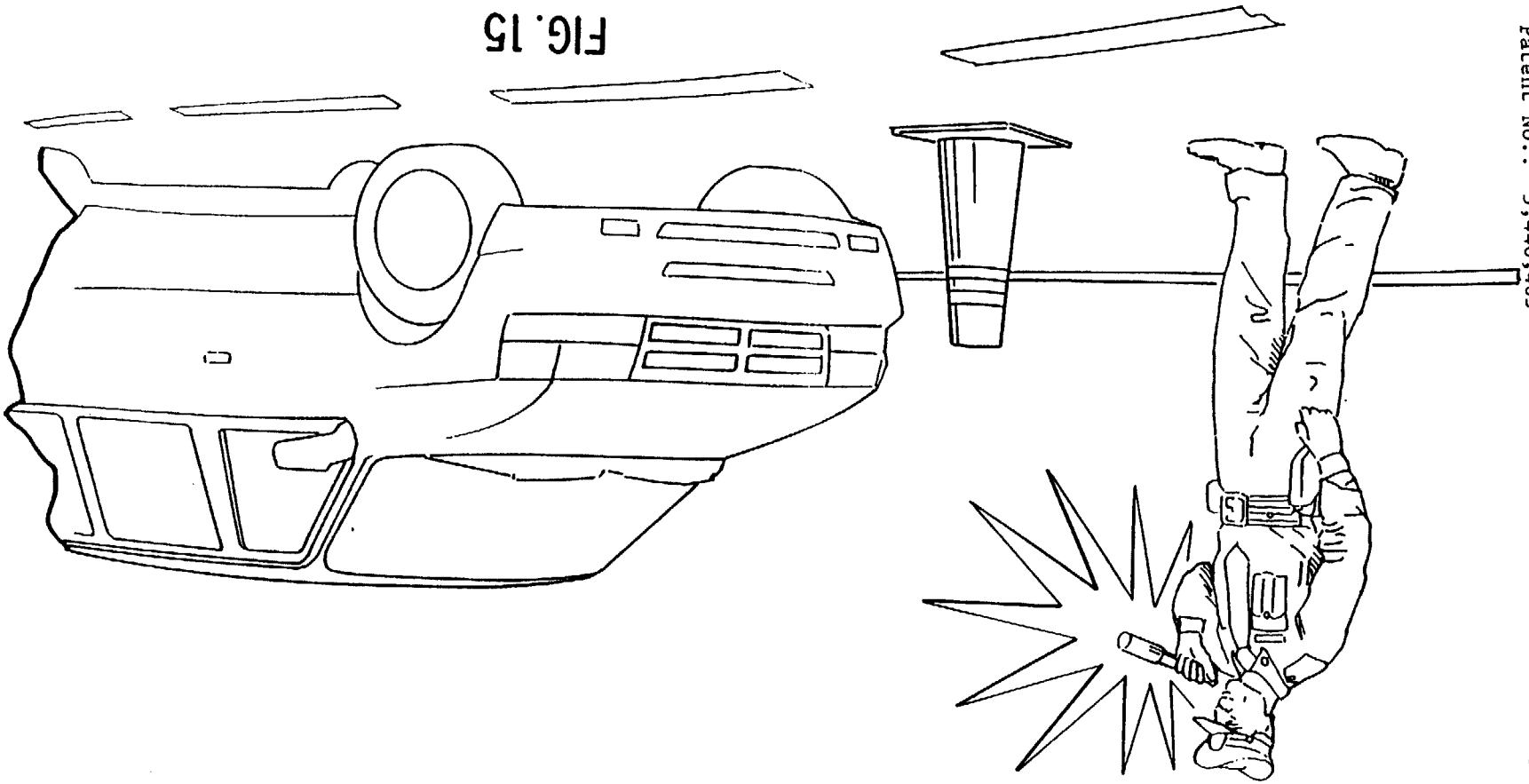

In another embodiment, a bracket-sleeve 4 may be used, in which case the longitudinal body portion of the light-wand 1 is inserted through the bracket-sleeve 4, while in a second embodiment, as shown in FIG. 16, the body portion of the wand 1 would be removably insertable from bracket-sleeve 4A by a sideways forcing action that would momentarily open axially split spring-like jaws. Bracket-sleeve 4 is attached to an appropriate retaining or attaching means generally incorporated into the belt of the user.

For both the embodiment involving the sleeve-clip 3 and the embodiment involving the bracket sleeve 4, the lightwand 1 is inserted into either the clip 3 or the sleeve 4 up to a position that abuts the necked down region of the lightwand 1 near its top end of the wand 1, so as to prevent the wand 1 from falling out of the clip 3 or sleeve 4, or inadvertently becoming dislodged.

Alternate embodiments of the sleeve-clip 3 and the bracket sleeve 4, respectively, are shown in FIG. 16, wherein numeral 3A shows an alternate sleeve-clip, and numeral 4B shows an alternate bracket-sleeve 4. The sleeve-clip 3A and the bracket-sleeve 4A, as shown in FIG. 16, differ from the sleeve-clip 3 and the bracket-sleeve 4 shown in FIG. 1, in that the sleeve-clip 3A is completely closed, and does not have the opening space of the sleeve-clip 3. The light-wand 1 is inserted into the sleeve-clip 3A up to a position that abuts the necked down region of the light-wand 1.

Conversely, the bracket-sleeve 4A is provided with a gap or opening as shown in FIG. 16, which assists in the insertion, removal and retention of the light-wand 1 from the bracket-sleeve 4A. Thus, the light-wand 1 is inserted into the bracket-sleeve 4A up to a position that abuts the necked down region of the light-wand 1 near its top end, so as to prevent the light-wand 1 from falling out of the sleeve 4, or inadvertently becoming dislodged.

Figure 3:
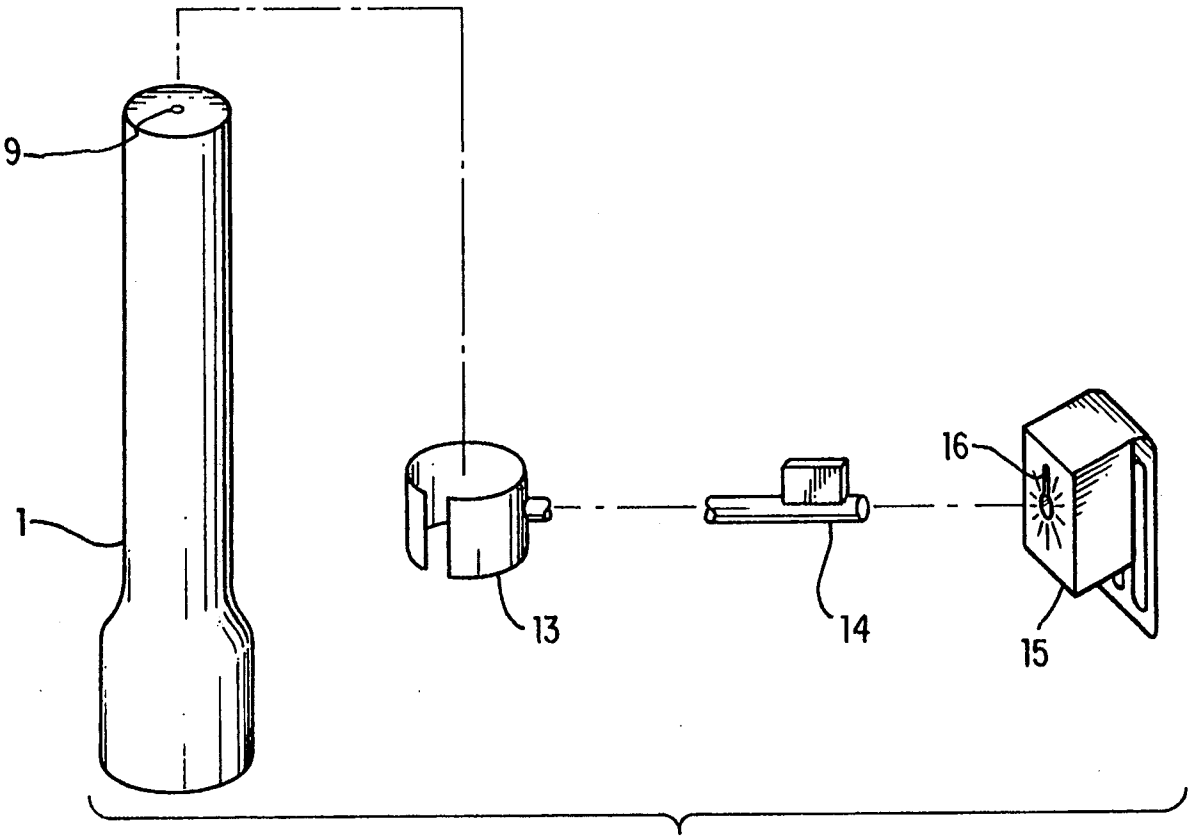
FIG. 3 shows the subject invention and its rotatable belt clip.

Additionally, the sleeve-clip 3 or the bracket-sleeve 4A, or the pivot-sleeve 13, each of which are provided with a gap or opening, as shown in FIGS. 1, 16, and 3 respectively, may be configured such that the gap or opening is large enough to allow insertion and removal of the light-wand 1 through the enlarged gap or opening. Thus, the light-wand 1 is not inserted through the top of the sleeve-clip, or bracket-sleeve, or the pivot-sleeve as previously discussed. By inserting the light-wand 1 through the enlarged opening provides a rapid and expedient method of stowing and deploying the invention 12. The light-wand 1 is still supported up to its necked down region as previously mentioned, but the inherent resilience and springiness of the sides of the clip 3 or sleeve 4A provide additional retention of the light-wand 1. Likewise, when the light-wand 1 is inserted through the enlarged opening of the clip 3, sleeve 4A, or sleeve 13, the inherent resilience and springiness of the sides of the clip 3 or sleeve 4A or sleeve 13 offer a reassuring snapping action which indicates that the light-wand 1 is the proper position and will not become unintentionally or inadvertently dislodged.

The securement location on the user's person, or any other attachment location of sleeve-clip 3 and bracket-sleeve 4 may alternatively be an integral part of ferrous member 6, which is utilized in conjunction with the incorporation of a magnetic member 5 onto and as part of the body of light-wand 1, a removable securement thereby being magnetically achieved.

A spring 10 of any well-known configuration, such as coil spring, helical spring, or the like, is positioned at the bottom of the wand 1, at an integral location. The spring 10 allows the light-wand 1 to accommodate internally any length of flashlight 11. The back end of the flashlight 11 abuts the spring 10 directly, and the spring 10 can serve to urge the top of the flashlight 11 out of the wand so that the flashlight 11 may be easily removed from the wand 1.

Figure 2:
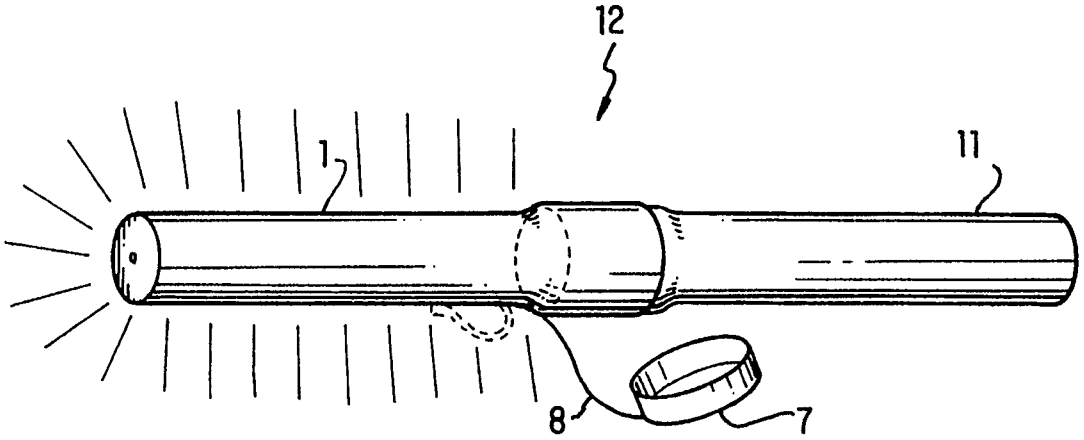
FIG. 2 shows the subject invention in its operable configuration.

Turning now to FIG. 2, the subject invention 12 is shown in its commonly used hand-held and operable configuration. The user would grasp the flashlight 11 in the well-known manner, with the light-wand 1 installed and attached as shown, and then proceed to direct aircraft or traffic or whatever efficiently. Light rays from the flashlight 11 would radiate liberally from the wand 1 due to the heretofore discussed optical diffusion properties of the translucent material chosen for the wand 1.

Another embodiment of the holster-wand 12 will now be discussed by referring to FIG. 3. The wand 1 can be carried on the belt of the user after being inserted into the pivot-sleeve 13 in much the same manner as previously discussed with reference to the sleeve-clip 3 or the bracket-sleeve 4 shown in FIG. 1.

That is to say, the light wand 1 is inserted into the pivot-sleeve 13 up to a position that abuts the necked-down region near the top end of the wand 1, so as to prevent the wand 1 from falling out of the pivot-sleeve 13 or inadvertently becoming dislodged. However, the pivot-sleeve 13 is provided with a key-like projection 14, which is an essential feature of the particular embodiment of invention 12 depicted in FIG. 3.

The key-like projection 14, may also be fixedly attached directly to the body of the holster-wand 1, in a permanent manner.

Removal of the holster-wand 1 from the pivot sleeve 12 is easy and conveniently accomplished by merely sliding the wand 1 out of the sleeve in a direction reverse to which the wand 1 was inserted.

The key-like projection 14 is inserted into the slot 16 on the belt-clip 15. The light-wand 1 is held by a sleeve 13, in the same manner as the sleeve 3 or bracket 4 which are shown in FIG. 1. A non-directional rotation feature within the key hole 16, "captures" the key 14 and rotatably secures it to the belt-clip 15. It should be noted that the pivot sleeve 13 may include an opening or gap, in the same manner as the respective sleeves or brackets discussed throughout, but mostly as discussed with respect to FIGS. 1 and 16.

In another embodiment (not shown) of the invention 12, the key-like 14 and key-slot 16 positions may be advantageously transposed, in that the key 14 could be part of a belt-clip 15, and the slot 16 for the key 14 could be located on the sleeve 13. The holster-wand 12 may then be either "free swinging" or, through the use of easily incorporated friction surfaces (not shown) or detents (also not shown), may be made to be practically lockable in any angular position that the user may desire.

In a still further embodiment, the magnetic surface of 17 which is fixedly attached to the body of the holster-wand 12 is removably mated with magnetic clip member 18, while providing for convenient, deliberate rotation and maintenance at any selected angular position.

Figure 8:
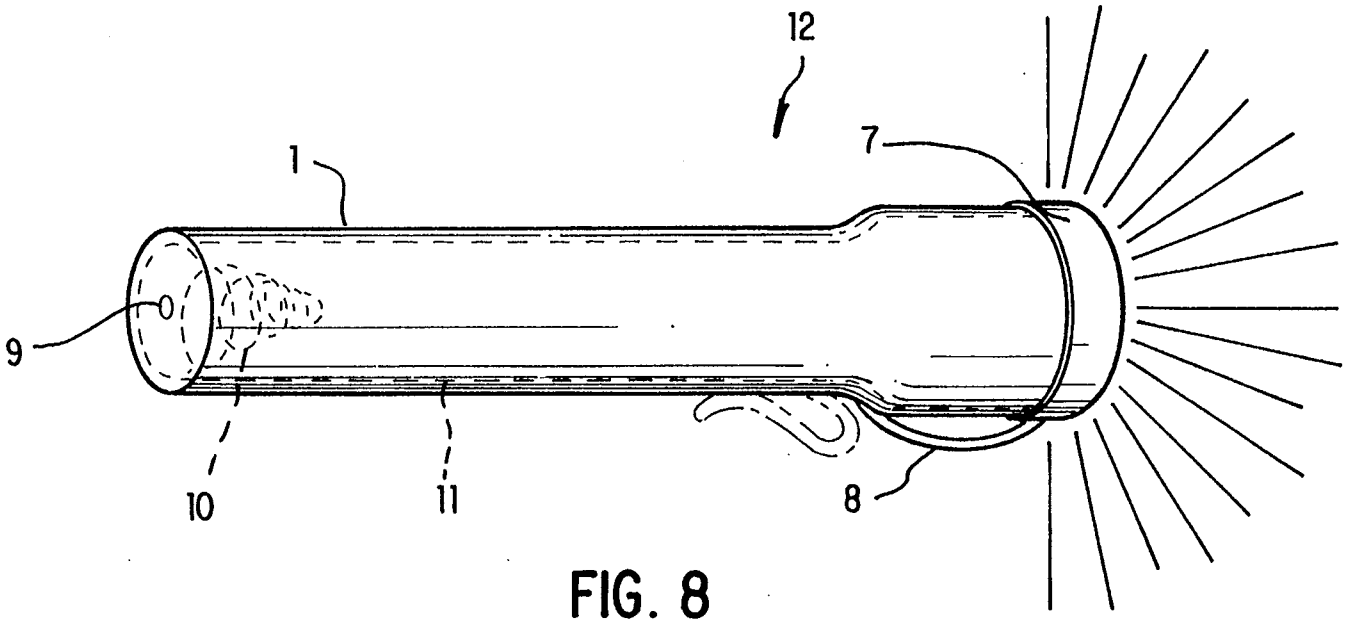
FIG. 8 shows an alternate use of the subject invention.
Figure 9:
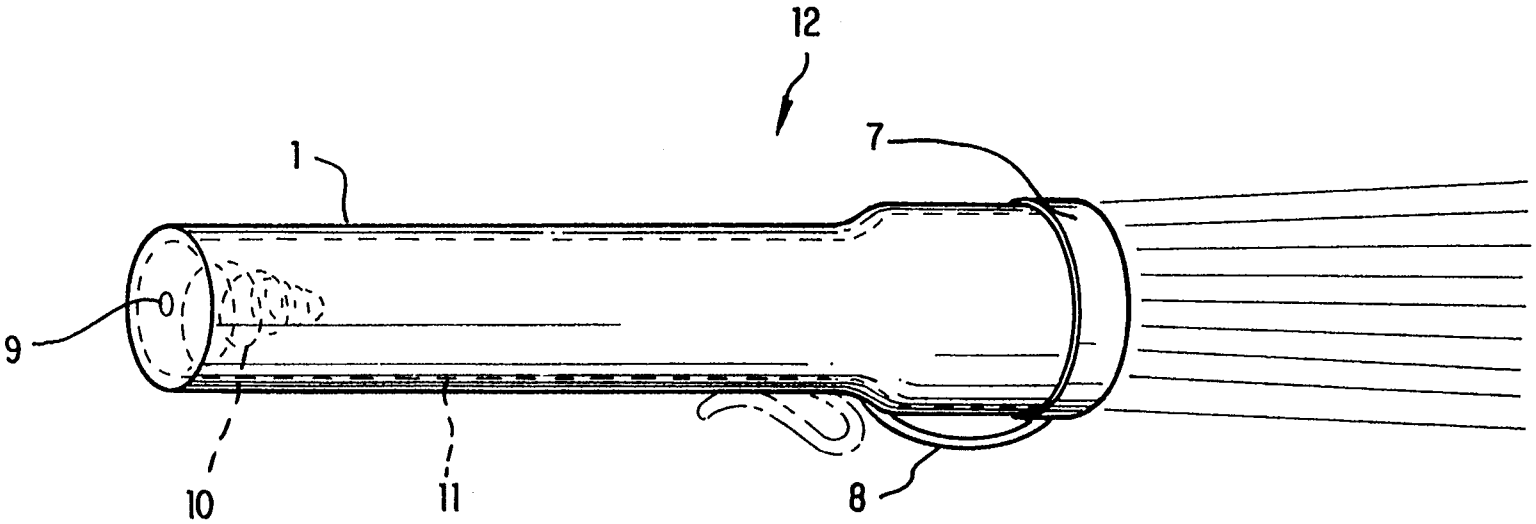
FIG. 9 shows yet another alternate use of the subject invention.
Figure 10:
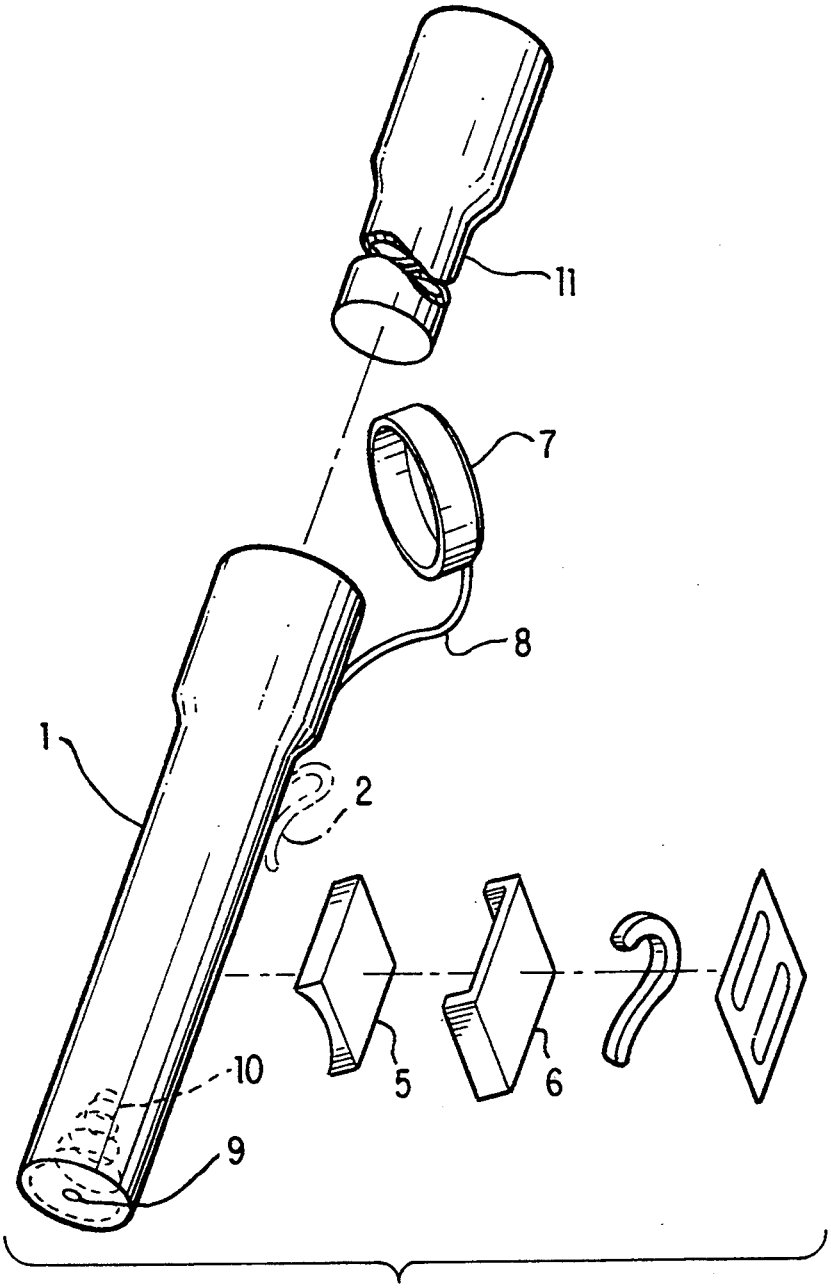
FIGS. 10–11 show alternate clips.
Figure 11:
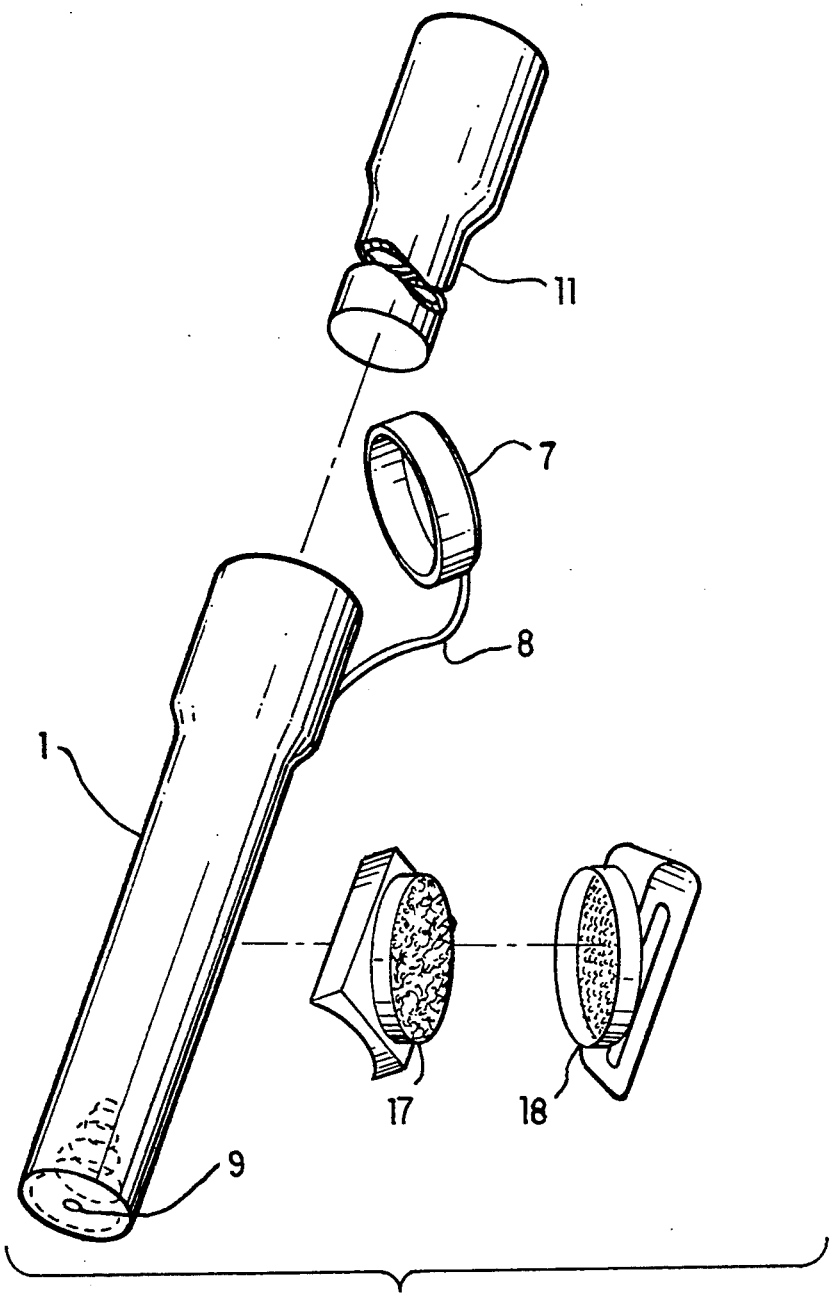

An essential feature of the instant inventive holster-wand device 12 is that a flashlight 11 may be used in the conventional manner while still protectively installed within the lightwand 1. Thus, flashlight 11 can be conveniently rotated and locked at an angle so as to illuminate a working area as shown in FIG. 8 or the immediate path ahead of the user, as shown in FIG. 9 and also FIG. 13, which will be discussed later. At a more horizontal angle, the far path ahead of the user may be illuminated. At a more vertical angle the device 1 can serve as a work or searchlight, or as a beacon which can be more readily seen from a distance, especially from an airborne vantage point, such as a helicopter or serial search plane.

On the other hand, if the flashlight 11 is installed so as to illuminate the wand. 1, in the manner commonly associated with a lightwand as shown in FIG. 2, the device 12 may be rotated and locked at various angles to convey observable information based on its illuminated direction, according to a prearranged code. The code may for instance involve rotation at a 45° angle to indicate one type of signal or at a 90° angle to indicate another type of signal.

Figure 7:
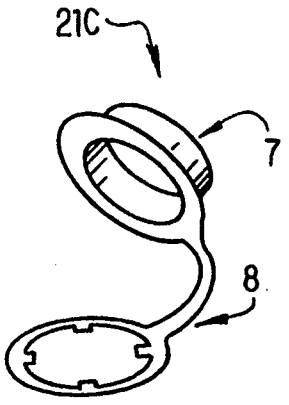
FIGS. 5–7 show alternate end caps for the subject invention.
Figure 6:
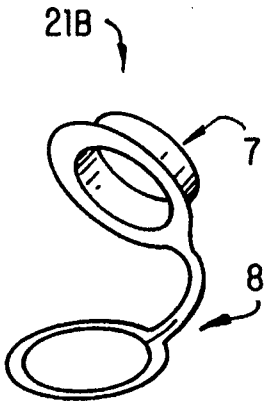
Figure 5:
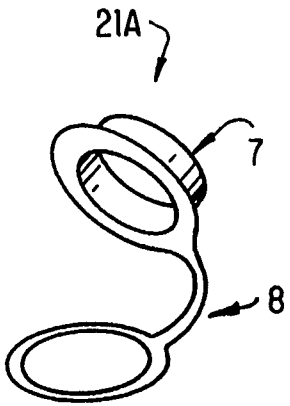
Figure 4:
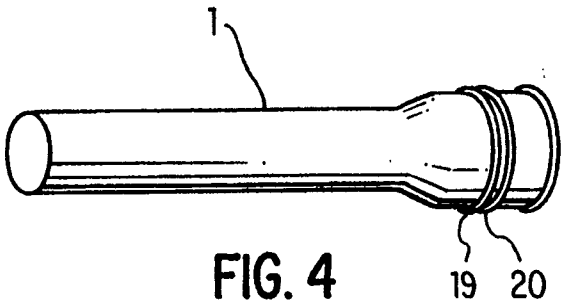
FIG. 4 shows another view of the subject invention.

FIGS. 5–7 show other contemplated embodiments of the protective cap 7. The various configurations of "bottle-cap like" items, which could serve the covering function of the protection cap 7 shown in FIG. 1, are designated as 21A–21C, and shown in FIGS. 5–7, respectively. The cap 21A shown in FIG. 5, simply stretches over an integrally formed first and second ridges 19, 20, on the exterior of the wand 1 and has enough elasticity to lock between the ridges 19 and 20 as shown on FIG. 4. Cap 21B shown in FIG. 6 simply opens at a split and, after installation between the ridges 19 and 20 of the wand 1, is secured by the ridges 19, 20 due to the line-up of the space between the ridges 19, 20. The same holds true for cap 21C which is forced over the first ridge 19 where it would be held in place by the elastic recovery of its inner resilient finger-like protrusions as shown in FIG. 7.

FIGS. 8 and 9 show the preferred configuration of the subject invention 12, with the cap 7 in its flashlight lens protection position. As stated earlier, the cap 7 may be transparent or translucent, according to the desires of the user. FIG. 8 provides an illustration of the translucent embodiment of the cap 7, such that light rays emanating from the flashlight 11 are widely dispersed according to the optical properties of which the cap 7 is made.

The embodiment of the invention 12 shown in FIG. 9 uses a transparent cap 7. Where the cap 7 is simply clear and transparent, thus allowing light rays emanating from the flashlight 11 to pass completely therethrough and unattenuated, also in accordance with the optical properties of the material, such as glass or clear thermoplastic, of which the cap 7 is made.

As FIGS. 8 and 9 illustrate, the flashlight 11 is completely contained or housed within the wand 1, and the cap 7, having its strap 8 attached thereto and also to the wand 1. In the configuration of FIGS. 8 and 9, the flashlight 11 as well as the interior of the wand 1 are reliably protected from dirt, dust, rainwater, snow, and any other such undesirable contaminants which may tend to interfere with the efficient and desirable operation of the invention 12.

The strap 8 is useful to prevent loss of the cap 7, after the cap is removed from its closing position on the wand 1, because, as shown in FIGS. 5–7 most clearly, the strap 8 is integrally formed with the cap 7.

It should be noted here that the cap 7 can be color coded in the same way as the wand 1 is color coded, which has already been discussed, thereby providing an identifying feature to the invention 12, while the invention 12 is in its arrangements illustrated in FIGS. 8 and 9.

Figure 13:
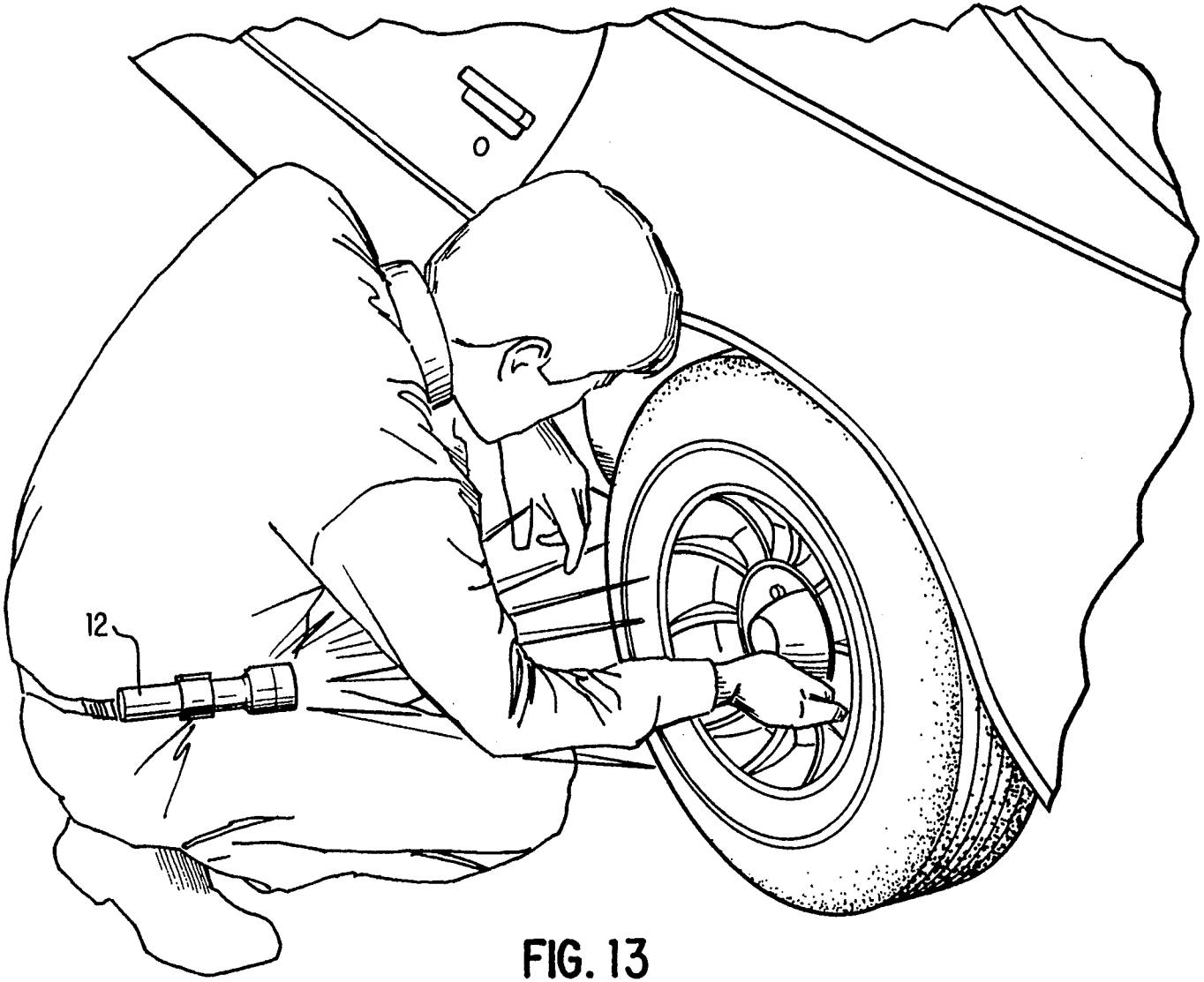
Figure 14:
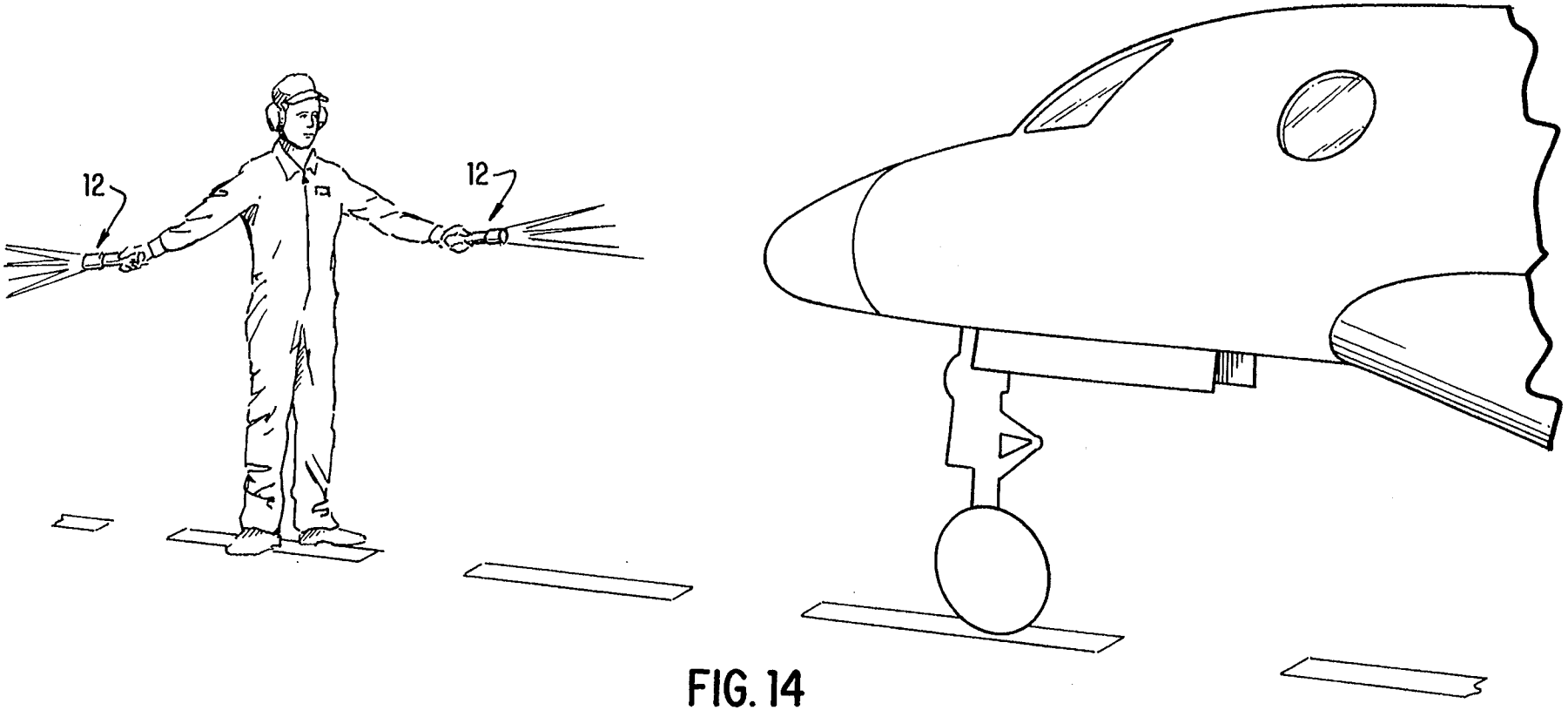
Figure 15:
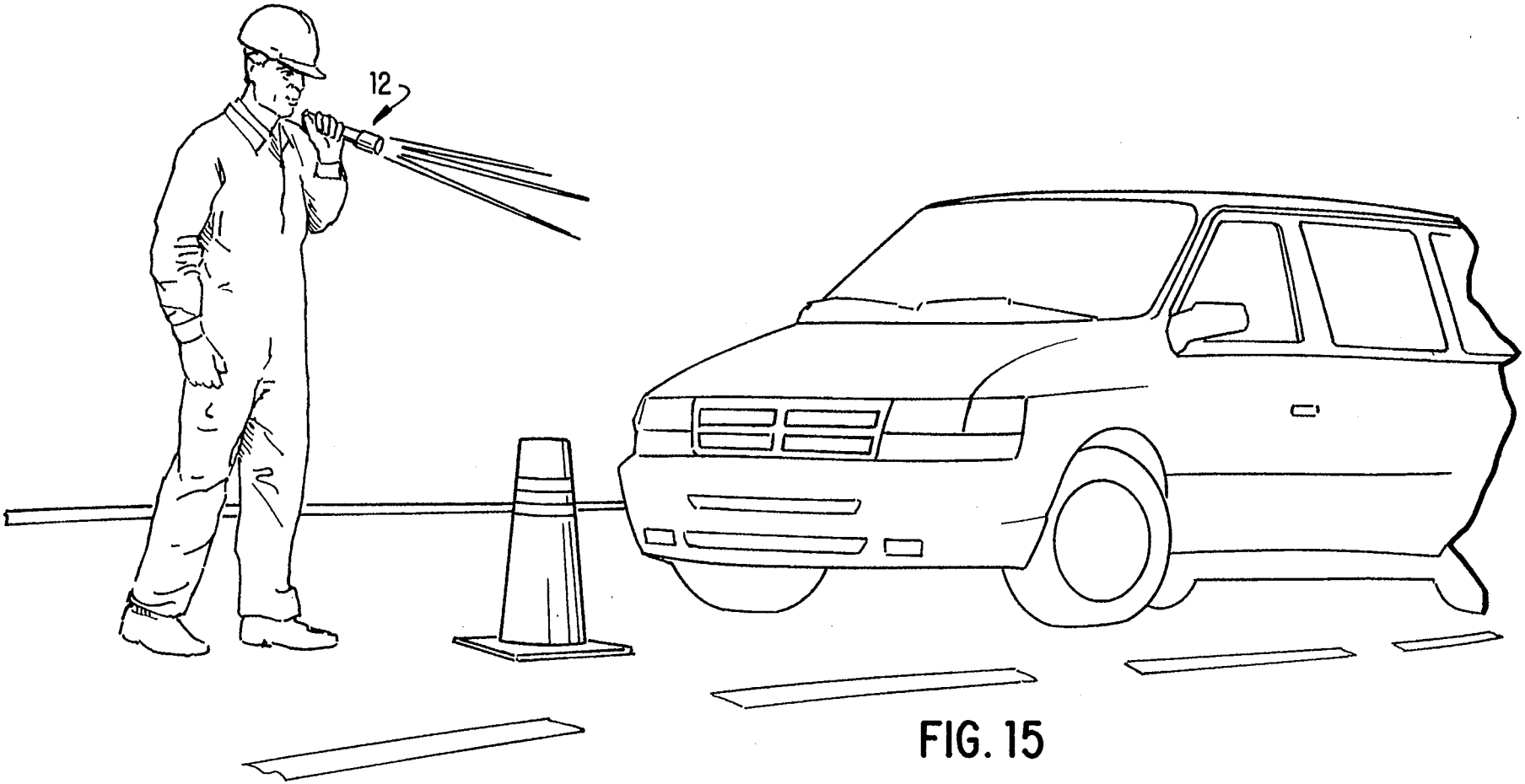

Conceivable users of the subject invention 12 are shown in FIGS. 12–15. For instance, FIG. 12 shows a jogger making very advantageous use of the invention 12 for safety purposes. FIG. 13 shows how a motorist is helped in making emergency roadside repairs by the invention 12. It can clearly be seen that the pivotability or rotatability of the invention 12 offers the motorist convenient hands-free mobility to make the necessary repairs. FIG. 14 shows an aircraft being safely and easily directed by the use of the invention 12, while the invention 12 is in the light-wand configuration shown in FIG. 2. Similarly, FIG. 15 shows a police officer diverting traffic using the invention 12, also in the light-wand configuration shown in FIG. 2.

Other possible uses of the invention are possible. Thus, the uses shown in FIGS. 12–15 are meant to serve as examples, and are in no way meant to be limiting.

While the holster-wand invention has been described in connection with a preferred embodiment, it will be understood that the invention is not limited to the disclosed embodiment. To the contrary, reasonable variations, alternatives, modifications and equivalents are possible within the scope of the foregoing disclosure without departing from the spirit of the invention as defined by the appended claims.

I claim:

1. An elongate container body of tubular cross-section, for accommodating therein a flashlight with the light projecting end of said flashlight directing out of said container, the container body comprising: a light-transmitting translucent body member substantially conforming in shape to said flashlight so as to accommodate the overall dimensions of said flashlight, the container body having a first end that is open, a second end that is closed and a removable cover member conforming to the overall circumferential dimensions of said first open end, whereby said flashlight is removably insertable into said tubular body through said first open end with the light projecting end of said flashlight exposed from said first open end, such that said removable cover member may be accommodated over said first open end.

2. The container body of claim 1, wherein said closed end is provided with a pressure release hole.

3. The container of claim 1, wherein said second end is open.

4. The container body of claim 1, wherein said removable end cap is translucent, thereby allowing light emanating from the light projecting end of said flashlight to diffusedly shine therethrough, when said end cap is positioned over said open end of the container body.

5. The container body of claim 1, wherein said removable end cap is transparent, thereby allowing light emanating from the light projecting end of said flashlight to project therethrough optically undiminished, when said end cap is positioned over said open end of the container body.

6. The container body of claim 1, including a resilient biasing means internally disposed within said tubular member at a location proximate to said closed second end, said resilient biasing means adapted to abut the end of the flashlight within said container body.

7. The container body of claim 1, further comprising a permanently attached securement clip having resilient biasing means for maintaining said clip in a closed position, said clip adaptable for attachment to objects or to a belt, waistband or edge of clothing worn by the user.

8. The securement clip of claim 7, further including a rotation preventing means.

9. The container body of claim 1, further comprising a demountable securement clip attachable to an object or to a belt, waistband or edge of clothing worn by the user; and from which the container body may be removably insertable therefrom, by a sideways action that momentarily forces open the axially split spring-like clamping jaws.

10. The securement clip of claim 9, further comprising a rotation prevention means.

11. The securement clip of claim 9, wherein an insertion means extending from said container body can be removably inserted therethrough.

12. The securement clip of claim 11, further comprising a rotation prevention means.

13. The container body of claim 1, further comprising a securement clip fixedly attached to a an article of clothing worn by the user, from which said container body may be removably suspended therefrom.

14. The securement clip of claim 13, further comprising a rotation prevention means.

15. The securement clip of claim 13, wherein when said clip is attached to said user's garment, said clip allows said container body to be removably insertable from said second end of said container body.

16. The securement clip of claim 15, further comprising a rotation prevention means.

17. The container body of claim 1, further comprising a permanent magnet element, said element disposed along a portion of said container body.

18. The magnetic element of claim 17, further comprising a permanent magnet means for attachment to a user's person or to a magnetic object.

19. The permanent magnet means of claim 18, further comprising means to provide for a fixed position, rotation prevention means.

20. The container body of claim 13, wherein said securement clip includes a rotation means to allow rotation of said container body while attached to a garment worn by the user, whereby said container body is rotatable about an axis perpendicular to the user's body, for orienting to a selectively chosen fixed angular position, maintained by frictional detent means, thereby causing light rays emanating from the light projecting end of said flashlight to fall in a plane that is substantially adjustable from the vertical plane to the horizontal plane.

21. The securement clip of claim 20, further comprising a means to provide a gravity controlled angular orientation.

22. The permanent magnet means of claim 18, further providing secured rotational means to allow for the purposeful rotation of said light-wand about an axis perpendicular to said user body, for orienting to a selectable angular position, said angular position maintained by magnetic attraction, thereby causing light rays emanating from the light projecting end of said flashlight to fall in a plane that is substantially adjustable from the vertical plane to the horizontal plane.

23. The container body of claim 1, wherein said translucent body member is adapted for attachment to the light projecting end of said flashlight, the translucent body member held snugly in place upon said light projecting end of said flashlight by interference fit.

24. The light-wand device of claim 22, being adapted to receive and substantially enclose a flashlight therein.

25. The securement clip of claim 13, whereby said container body is insertable into and removable from said clip via an opening in the side thereof.

26. A hand-held light-wand device, comprising a translucent tubular body member having a necked down region near a first open end, a closed second end disposed distally therefrom, a light transmitting removable end cap and a securement clip, whereby the head end of a flashlight may be operably received within the first open end of the light wand device such that the light projecting end of said flashlight is snugly received by said necked-down region, thereby causing light rays emanating from said flashlight to illuminate the length of said translucent tubular body member.

27. The light-wand device of claim 26, wherein said second closed end is provided with a pressure release hole.

28. The light-wand device of claim 26, wherein said second end is open.

29. The light-wand device of claim 26, further comprising a non-removable securement clip, including a resilient closing means, said securement clip is attachable to objects or to an article of clothing worn by the user of said light-wand device.

30. The clip of claim 29, further comprising a rotation prevention means.

31. The light-wand device of claim 26, further comprising a securement clip attachable to an object or to an article of clothing worn by the user of said light-wand device, from which said light-wand may be removably insertable therefrom.

32. The securement clip of claim 31, further comprising a rotation prevention means.

33. The securement clip of claim 31, wherein said clip allows said light-wand to be removably insertable therefrom.

34. The securement clip of claim 31, further comprising a rotation prevention means.

35. The light-wand device of claim 26, further comprising a securement clip fixedly attached to a belt worn by the user and from which said light-wand is removably insertable therefrom.

36. The clip of claim 35, further comprising a rotation prevention means.

37. The securement clip of claim 34, further comprising a resiliently biased opening through which said light-wand can be removably inserted.

38. The securement clip of claim 37, further comprising a fixed position, rotation prevention means.

39. The light-wand device of claim 26, further comprising a permanent magnet.

40. The light-wand device of claim 39, further comprising permanent magnet attachment means for attachment to an object or to an article of clothing worn by the user of said lightwand device.

41. The lightwand device of claim 40, including a rotation prevention means.

42. The light-wand device of claim 35, wherein said permanent magnet attachment means includes a rotation means for allowing selectable rotation of said light-wand device while attached to a garment worn by the user, about an axis perpendicular to the user's person, for orientation to a selectively chosen fixed angular position, said position maintained by frictional detent action, thereby causing light rays emanating from along the length of said light-wand to fall in a plane that is substantially adjustable from the vertical plane to the horizontal plane.

43. The permanent magnet attachment means of claim 42, further comprising a coupling means to provide gravity controlled angular rotation of said light-wand device.

44. The permanent magnet attachment means of claim 40, further providing secured rotation to allow for the purposeful rotation of said light wand about an axis perpendicular to a wearer's body, for orienting to a selectively chosen fixed angular position, maintained by magnetic attraction, thereby causing the light rays emanating from along the length of said light-wand to fall in a plane that is substantially adjustable from vertical to horizontal.

45. The securement clip of claim 31, whereby said light-wand device is insertable and removable therefrom via a resiliently biased opening extending along said clip.

* * * * *

UNITED STATES PATENT AND TRADEMARK OFFICE

CERTIFICATE OF CORRECTION

PATENT NO. : 5,440,465

DATED : Aug. 8, 1995

INVENTOR(S) : Richard S. Hasness

It is certified that error appears in the above-indentified patent and that said Letters Patent is hereby corrected as shown below:

In FIG. 3, 12, 14, and 15, appliant notes that substitute drawing figures, submitted on June 20, 1995, were not entered. Inclusion of the corrected drawings in the Certificate of Correction is requested.

Column 2, line 62, delete "FIG. 1" and insert --FIG. 2--.

Column 3, line 57, delete "4B" and insert --4A--.

Column 4, line 21, delete "sleeve 4A" and insert --sleeves 4A and 13--.

Column 7, claim 7, line 2, before "an" delete "a".

Column 9, claim 34, line 1, delete "31" and insert --33--.

Signed and Sealed this

Fourteenth Day of November, 1995

Bruce Lehman

*Attest:*

BRUCE LEHMAN

*Attesting Officer*

*Commissioner of Patents and Trademarks*